United States Patent [19]

Lindner et al.

[11] 4,442,642

[45] Apr. 17, 1984

[54] WALL ASSEMBLY

[76] Inventors: Robert L. Lindner, 3154 Valley Green La., Napa, Calif. 94558; Luther Marshall, 21 View Ridge Dr., Novato,, Calif. 94947

[21] Appl. No.: 248,397

[22] Filed: Mar. 27, 1981

[51] Int. Cl.[3] ..... E04B 1/00; E06B 3/54

[52] U.S. Cl. ..... 52/98; 52/489

[58] Field of Search ..... 52/98, 99, 100, 357, 52/358, 363, 712, 714, 715, 489, 486, 483

[56] References Cited

U.S. PATENT DOCUMENTS

| | | | |
|---|---|---|---|
| 3,922,764 | 12/1975 | Downing, Jr. | 52/489 |
| 3,934,387 | 1/1976 | Moeller | 52/489 |
| 4,255,910 | 3/1981 | Wendt | 52/489 |

FOREIGN PATENT DOCUMENTS

| | | | |
|---|---|---|---|
| 2007751 | 5/1979 | United Kingdom | 52/489 |

*Primary Examiner*—John E. Murtagh
*Assistant Examiner*—Andrew Joseph Rudy
*Attorney, Agent, or Firm*—John L. McGannon

[57] ABSTRACT

A wall assembly comprised of a number of wall panels releasably coupled by clips of improved construction to spaced, vertical studs. Each wall panel has an end face and each clip has a number of tines or teeth which are forced or driven into the end face of the corresponding wall panel. The clip further has a resilient part mounted on a base part which engages the adjacent surface of a wall panel. The resilient part yields in one direction when it engages the adjacent flange of the stud as the wall panel is forced toward the stud in a horizontal direction. This permits the resilient part to pass by and thereby clear the flange of the stud, whereupon the resilient part snaps back behind the flange and thereby releasably couples the wall panel to the flange with the wall panel at the front of the flange. The resilient part is breakable from the body of the clip when the wall panel is pulled in a horizontal direction away from the stud, thereby permitting removal of the wall panel from the wall assembly. New clips are put in place on the wall panel when it is to be re-installed.

5 Claims, 4 Drawing Figures

FIG. 1
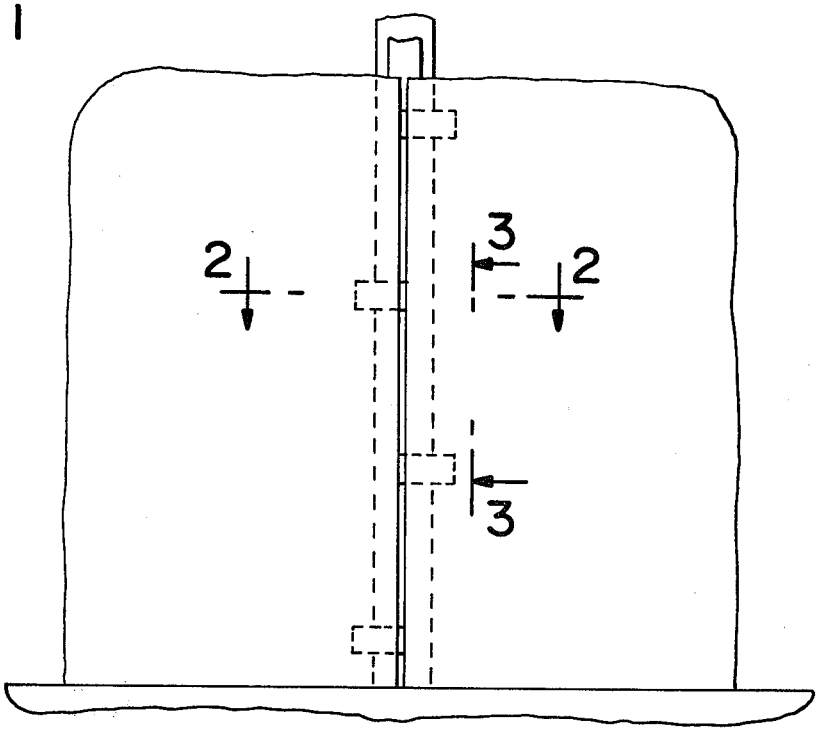
FIG. 2
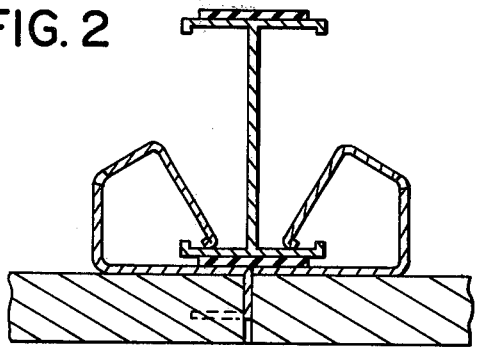
FIG. 3
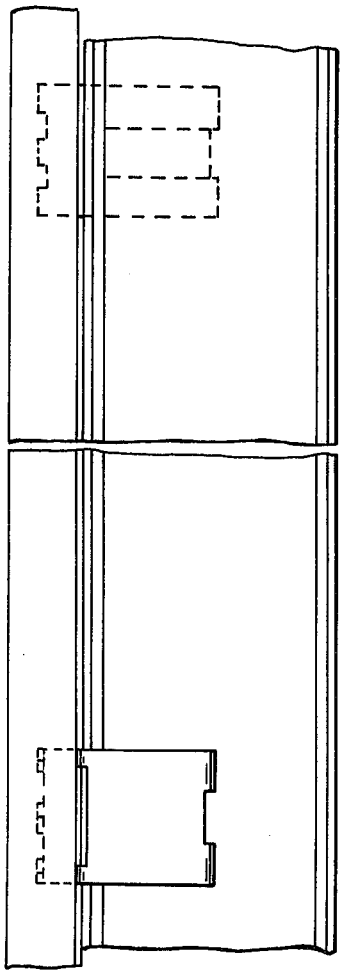
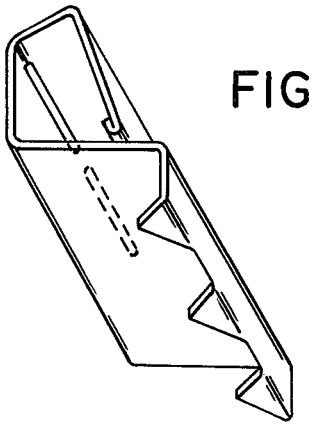
FIG. 4

WALL ASSEMBLY

This invention relates to improvements in the construction of wall assemblies with face panels such as plywood, gypsum wallboard and the like and, more particularly, to an improved wall assembly which has a number of wall panels releasably mounted in place.

BACKGROUND OF THE INVENTION

The mounting of wall panels in place on vertical studs to form a wall assembly has been accomplished in a number of different ways. Nails, screws and other such mechanical fasteners have been used for this purpose. Also, adhesive tape has been provided on the studs for adhesively engaging the adjacent wall panels to releasably secure the wall panels in place on the studs. Disclosures relating to the use of such tape are found in U.S. Pat. Nos. 4,041,667 and 4,069,639.

While the foregoing connecting means are satisfactory in many applications, it is possible that they are not suitable in cases where the wall panels are twisted, warped or bowed. It has been found that various wall panels, such as plywood, gypsum wallboard and the like are often manufactured and shipped to job sites without carefuly handling. Many such panels arrive twisted, warped or bowed and, in this condition, they will not stay in place when installed in a wall using conventional connecting means of the type described above.

Because of this problem a need has arisen for an improved wall assembly and means for mounting the wall panels of such an assembly to accommodate wall panels that the twisted, warped or bowed or otherwise damaged in manufacture or shipment so that the wall panels will be usable and need not necessarily be discarded.

SUMMARY OF THE INVENTION

The present invention satisfies the aforesaid need by providing an improved wall assembly comprised of a number of wall panels which are releasably secured to adjacent studs by fastening clips of improved construction. To this end, the clips of this invention have tines which are driven into the end faces of corresponding wall panels to secure the clips to the wall panels. The clips also have resilient legs which yield in one direction as they are engaged by the flanges of the studs when the wall panels are moved horizontally towards the studs and into operative positions adjacent to the studs. This allows the clips to pass by the flanges and snap back behind the flanges to releasably couple the wall panels to the studs. The legs are breakable or capable of being sheared off the main body of the clip when the wall panels are pulled in a horizontal direction away from the studs, thereby allowing the wall panel to be separated from the wall assembly itself if entry into the interior of the wall assembly is desired. The wall panel can then be replaced by the use of new clips coupled to the side margins thereof.

The primary object of the present invention is to provide an improved wall assembly comprised of a number of wall panels releasably coupled by improved clips to vertical studs wherein the clips are easy to use and permit the wall panel to move directly toward the studs in a horizontal direction to couple the wall panels to the studs, yet the clips can be broken when it is desired to remove a wall panel, all of which can be accomplished even though the wall panels are initially twisted, warped or bowed due to defects in manufacture or damage caused during shipment.

Other objects of this invention will become apparent as the following specification progresses, reference being had to the accompanying drawings for an illustration of the invention.

BRIEF DESCRIPTION OF THE DRAWINGS

FIG. 1 is a fragmentary side elevational view of a wall assembly of the present invention showing the spaced clips for releasably mounting a pair of adjacent wall panels on a stud;

FIG. 2 is an enlarged, cross-sectional view taken along line 2—2 of FIG. 1;

FIG. 3 is an enlarged, cross-sectional view taken along line 3—3 of FIG. 1; and FIG. 4 is an enlarged, perspective view of a mounting clip for a wall panel of the invention.

The wall assembly of the present invention is broadly denoted by the numeral 10 and includes a number of vertical wall panels 12, only two of which are shown but the number could be much greater, if desired. Assembly 10 further includes a plurality of vertical I-shaped studs 14, only one of which is shown in FIG. 1. The wall panels have resilient clips 16 at spaced locations along their side margins for releasably attaching the wall panels to adjacent studs 14. A clip 16 is shown in greater detail in FIG. 4 and a way in which a clip is releasably connected to the stud is shown in FIG. 2.

Wall panels 12 can be of plywood, gypsum wallboard or the like. Each wall panel typically has a height which extends from the ceiling to the floor of the space in which wall assembly 10 is to be constructed. Each stud 14 is typically mounted between a ceiling runner and a floor runner, neither of which runners are shown in FIG. 1. It is desirable that each wall panel be removably mounted on adjacent studs so that the wall panel can be moved into and out of operating position for any one of a number of different reasons. Clips 16 permit this ready removal of a wall panel from its operating position in a manner to be described.

Each clip 16 is formed from a single piece of resilient material, such as spring steel. However, the clip can be formed from plastic. Clip 16 has a flat base part 18 provided with a lateral end wall extension 20 having three tines or teeth 22 at the outer edge thereof, the tines extending generally parallel with the base part 18 and spaced laterally therefrom for embedding into the end of face 24 (FIG. 2) of a wall panel 12. When so embedded, the tines hold base part 18 against the rear face 26 of panel 12 yet the tines can be pulled out of the wall panel to replace it with another clip.

Clip 16 has a first projecting part 28 integral with and extending laterally from base part 18 at end margin 30 thereof. The connection between parts 18 and 28 permits yielding of part 28 relative to base part 18. This allows part 28 to pivot in the direction of arrow 31 (FIG. 2) relative to part 18 when part 18 engages rear face 26 of wall panel 12 and as the clip is forced over flange 33 of a stud 14 in a manner to be described.

A second projecting part 32 is integral with the outer marginal edge 35 of part 28. Part 32 has a segment **32*a* which extends away from base part 18 and a segment 32*b* which extends toward end wall 20. It has an outer marginal edge adjacent to or engaging flange 33 of a stud 14 when the clip is in its operative position shown in FIG. 2. Thus, the clip releasably holds wall panel 12** on the stud.

Part 32 can be broken or sheared off from its connection to part 28 when a force pulls the wall panel away from the adjacent stud. Clip 16 has one or more slots 39 therein at marginal edge 35 to weaken this location and make it easier to shear part 32 from part 28 when a pulling force is exerted on the corresponding panel 12.

In use, wall assembly 10 is constructed by first mounting studs 14 in place extending between ceiling and floor runners (not shown). For control of sound through wall 10, a strip 40 of sound absorbing tape can be adhesively or otherwise attached along the outer, flat face of each flange 33, respectively, of stud 14, if desired. If adhesively attached, strip 40 can have adhesive on both sides or only the side facing flange 33. This tape strip can be omitted if it is considered to be unnecessary.

One or more clips 16 are then coupled to each end face 24 of a wall panel 12. Then the wall panel is forced directly toward the adjacent studs and as clip 16 approaches flange 33 of each stud, part 32 of clip 16 engages the flange and is cammed thereby in the direction of arrow 30 (FIG. 2), causing part 28 to pivot in a counterclockwise sense when viewing FIG. 2 until part 32 passes the outer edge margin of the flange. When this occurs, part 32 then springs back behind the flange and into the position shown in FIG. 2, causing the clip to be releasably coupled to the flange and thereby causing the wall panel to be releasably coupled to stud 14. This is accomplished in a matter of seconds so that a large number of wall panels 12 can be erected to form wall assembly 10 in a minimum of time.

When it is desired to remove a wall panel from wall assembly 10, the wall panel is pulled straight out from the adjacent studs 14. However, the outward movement of the wall panel is resisted by the engagement of part 32 with flange 33 of the stud. However, the wall panel is continually moved outwardly and part 32 shears off from part 28 at marginal edge 35 (FIGS. 2 and 4), thereby allowing unrestricted outward movement of the wall panel away from the studs. When the wall panel is to be replaced in the wall assembly, new clips 16 will be mounted on the wall panel and the wall panel will then be put into place in a manner described above.

The use of clips 16 eliminates the problems associated with wall panels that are twisted, warped or bowed. The clips therefore avoid the possibility of loose panels in wall assemly 10. Also, the clips provide a permanent, concealed mechanical fastener which positively holds the wall panel in place yet allows the wall panels to be removed if desired.

Slots 39 can be relatively long so that only relatively short segments of parts 28 and 32 are interconnected with each other. This feature permits ready removal of the wall panels. This feature also minimizes the sound that is transmitted from the wall panels to the stud since the relatively short segments interconnecting parts 28 and 32 will have only a minimal or negligible tendency to transmit sound from a wall panel through a clip to the adjacent stud.

What is claimed is:

1. In a wall assembly: a study having a flat flange; a wall panel having a side margin; and a spring clip carried by the side margin of the wall panel and having a resilient part provided with an outer marginal edge movable into engagement with one face of the flange of the stud when the wall panel is adjacent to the opposite face of the flange for releasably mounting the wall panel on the study, said resilient part having a resilience permitting the wall panel to move generally horizontally toward the stud when the stud is vertical until the resilient part has yielded and moved about one outer extremity of the flange and then has sprung back to cause said outer marginal edge to engage said one face of the flange to releasably connect the clip to the flange, said resilient part having breaking means permitting it to be breakable from the reminder of the clip to separate said clip remainder from the flange when the wall panel is moved away from the stud.

2. In a wall assembly as set forth in claim 1, wherein said wall panel has an end face, said clip having a number of spaced tines capable of being driven into the end face and to be embedded in the wall panel.

3. In a wall assembly as set forth in claim 1, wherein said clip includes a base part engageable with an adjacent face of the wall panel, means coupled with the base part for securing the clip to the wall panel, said resilient part being yieldably coupled to the base part for engaging the flange, said resilient part being yieldable in one direction relative to the base part as the wall panel moves toward the stud and when the resilient part is on one side of and engages the flange, said resilient part being movable in the opposite direction when the resilient part is on the opposite side of the flange to assure that the resilient part will be behind the flange to couple the clip to the stud.

4. In a wall assembly as set forth in claim 3, wherein a portion of said resilient part is capable of being sheared from said base part when the wall panel is moved away from the stud.

5. In a wall assembly as set forth in claim 4, wherein said resilient part includes a first projecting part extending laterally from the base part and a second projecting part extending laterally from the first projecting part, the junction between the first and second projecting parts being slotted to provide a breakable connection defining said breaking means therebetween which can be broken when the base part of the clip is pulled away from the flange the second projecting part being separable from the first projecting part.

* * * * *